United States Patent [19]

Wendel

[11] 4,151,730

[45] May 1, 1979

[54] LAUNDRY HOT WATER SUPPLY SYSTEM

[75] Inventor: Ion L. Wendel, St. Petersburg, Fla.

[73] Assignee: James L. Lowe, St. Petersburg, Fla.

[21] Appl. No.: 732,488

[22] Filed: Oct. 14, 1976

Related U.S. Application Data

[63] Continuation-in-part of Ser. No. 660,323, Feb. 23, 1976.

[51] Int. Cl.[2] ..... D06F 31/00; D06F 39/04; D06F 58/00

[52] U.S. Cl. ..... 68/20; 34/90; 68/27; 134/107

[58] Field of Search ..... 68/20, 27, 207, 3 R, 68/13 R, 19; 34/86, 90, 19, 35; 122/20 A, 20 B, 420, 432; 134/105, 107, 108

[56] References Cited

U.S. PATENT DOCUMENTS

| | | | |
|---|---|---|---|
| 2,143,874 | 1/1939 | Hagenson et al. | 122/20 A |
| 3,771,238 | 11/1973 | Vaughn | 68/20 X |

*Primary Examiner*—Philip R. Coe
*Attorney, Agent, or Firm*—William E. Mouzavires

[57] ABSTRACT

A laundry dryer source of heat for providing warm gas to dry laundry is utilized to heat water for laundry washer use, and is particularly suited for coin operated laundries. In the illustrated embodiment each dryer has a gas burner and a water coil is in the flame area of the burner, the coils being connected in circuit between a cool water outlet and a heated water inlet of a typical automatic water heater tank. A water circulating system includes a pump or pumps for circulating cool water from the tank through coils and returning heated water from the coils to the tank whenever any of the dryers are in operation. One embodiment of the circulating system assures continuous water flow through the plurality of dryer water coils during heating operation by providing a substantially equal pressure differential between the cold water inlet and the hot water outlet of each of the coils. A cross-over between hot and cold water headers may be provided intermediate the series of dryer coils for increasing the temperature of the hot water delivered to the hot water tank. Since most laundry is promptly placed in a dryer after washing, during high or low capacity operation of the laundry the quantity of heated water is automatically regulated by dryer operation to the overall demand for hot water by the washers, the automatic water heater tank providing heated water during sudden surges in washer operation before the dryers are in operation sufficiently to supply the hot water.

19 Claims, 4 Drawing Figures

FIG. 3
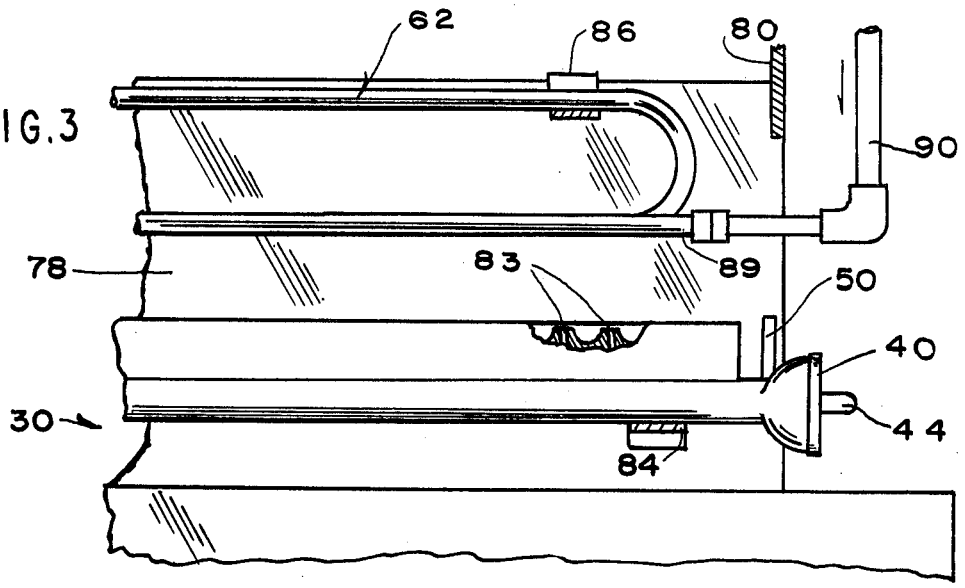
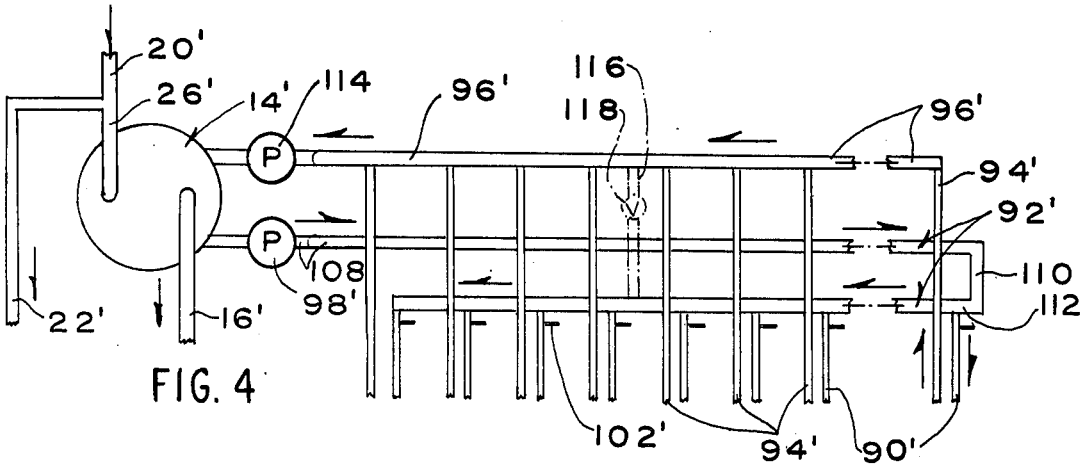
FIG. 4

LAUNDRY HOT WATER SUPPLY SYSTEM

This application is a continuation-in-part of my copending patent application Ser. No. 660,323, filed Feb. 23, 1976.

This invention relates to laundry hot water supply and, more particularly, to an energy conservation system for providing heated water for washers by utilizing a dryer heat source.

BACKGROUND OF THE INVENTION

During low or normal capacity washer usage the automatic water heater provides adequate hot water for the washers in a laundry, but upon continuous heavy usage of the washers the water heater may prove to be inadequate and as a result the washers will be provided with lukewarm if not cold water. In typical coin operated laundries, one dryer is usually provided for two washers, with about ninety-five percent of the washed laundry generally being dried in the dryers. A system for preheating water for the automatic water heater is shown in a recently issued patent, U.S. Pat. No. 3,771,238, in which a portion of the cold water normally supplied to the water heater is preheated by passing it through coils exposed to the warm vent gases recirculated through the dryer. However, since the vent gas temperature is relatively low, this patented system can do no more than preheat water for the automatic water heater, it cannot heat the water to normal water supply temperatures. Additionally, this system is controlled responsive to water temperature in the automatic water heater rather than responsive to operation of one or more of the dryers. Among the references cited in the previous noted patent is U.S. Pat. No. 3,050,867, which is quite similar but uses water heating coils in the individual vent flues of the dryers, and this system is controlled responsive to flue gas temperature rather than to the temperature of water in an automatic water heater as in the other patent. Another citation in the first noted patent is U.S. Pat. No. 1,731,290, which uses waste heat of a laundry environment for heating water. Other patents include U.S. Pat. No. 3,173,767, directed to a steam heated clothes dryer, and shows steam coils in an upper portion of the dryer for warming drying air which is circulated through the remainder of the dryer. U.S. Pat. No. 2,564,798 has separate compartments for washing, sterilizing, and drying dishes, and has burners for heating water coils, the exhaust of the burners being passed through a large conduit over which drying air is heated.

SUMMARY OF THE INVENTION

The invention, in brief, is directed to a laundry hot water supply system and apparatus in which a coil unit carrying water to be heated is positioned proximate a laundry dryer heater which warms laundry drying gas circulated to the drying chamber of the dryer for drying the laundry. The coil unit is positioned in the combustion area and, more particularly in the flame area of a combustion type burner which is usually an integral part of the dryer. In a preferred embodiment of a coin operated laundry having a number of dryers, cool water from the usual automatic water heater which provides hot water for washers, is passed by a circulating system to the coil units, the water being provided at a substantially constant pressure differential between the inlet and outlet of each of the coil units of the dryers. The resultant heated water is returned to the water heater sufficiently hot for use by the washers, particularly during peak periods of laundry operation when the supply of hot water may otherwise become inadequate. If it is desired to increase the temperature of the resultant hot water, a cross-over may be provided between cool and heated water headers of the circulating system which may also include a pair of pumps, one in the cool water header and the other in the heated water header. The apparatus and system is particularly suited for use in coin operated laundries since, in a practical sense, the number of drying periods for a given load of wet laundry is the same with or without use of the subject water heating system and apparatus.

It is an object of this invention to provide a new and useful laundry hot water supply system.

A further object is provision of a new and useful laundry hot water supply system which effectively reduces the energy requirements of the laundry.

Still another object is provision of new and useful laundry hot water supply system which may be easily and economically installed in existing laundries.

A more specific object is provision of a laundry hot water sypply system including a laundry dryer having a chamber for receiving laundry to be dried with a source of warm gas delivered to the chamber for drying the laundry therein, the source including a heater for heating the gas responsive to operation of the dryer, and a water handling system including a water holding container, such as a coil, intimately associated with the heater upstream of the chamber relative to the flow of warm gas from the heater to the chamber, for heating the water by means of the heat generated by the heater, with a receiver for the heated water from the coil and, more particularly, the heater having sufficient capacity for heating the water to a normal temperature for washing and simultaneously heating the warm gas to a normal temperature for drying the laundry. A related object is provision of a plurality of dryers each with a coil, and a system for circulating cool water from a receiver to the coils and heated water from the coils back to the receiver while maintaining a substantially constant pressure differential between the inlet and outlet of each of the coils. A further related object is provision of the dryer heater in the form of a combustion type burner which provides a combustion area and, more particularly, a flame area during normal operation, and the coil being positioned in the flame area of the burner. Still another related object is provision of such a system in a coin operated laundry having a plurality of coin operated washers and dryers and wherein the overall quantity of water heated by the dryers is generally proportional to the overall use of hot water by the washers.

These and other objects and advantages of the invention will be apparent from the following description and the accompanying drawing.

BRIEF DESCRIPTION OF THE DRAWING

FIG. 3 is an enlarged, fragmentary, schematic, sectional elevational view taken generally along the line 3—3 in FIG. 2, with parts broken away and removed for clearer illustration; and FIG. 4 is a schematic fragmentary plan view similar to a portion of FIG. 1 but illustrating a preferred embodiment of a water circulating system.

DESCRIPTION OF THE ILLUSTRATED EMBODIMENT

Figure 1:
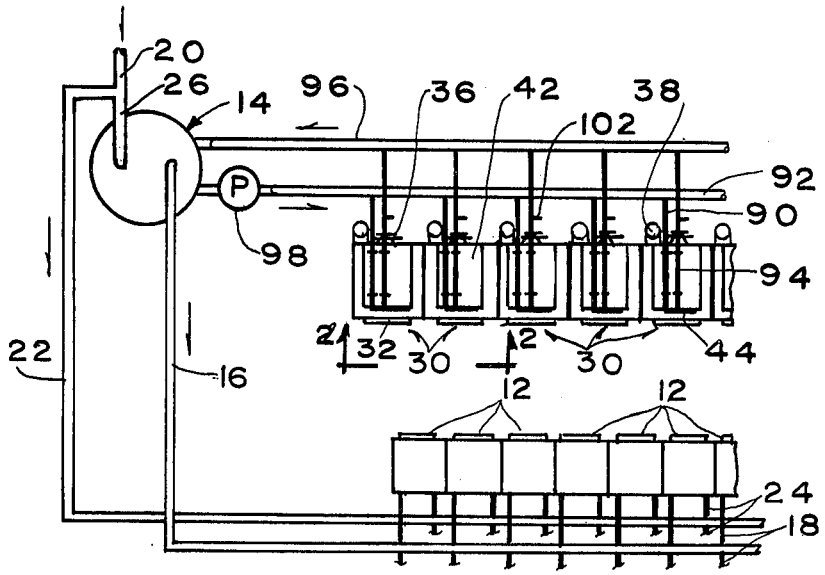
FIG. 1 is a schematic, fragmentary plan view of a portion of a coin operated laundry.

FIG. 1 of the drawing schematically illustrates a portion of a typical coin operated laundry having a plurality of coin operated washers 12 which receive hot water from an automatic water heater 14, including a storage tank, by means of a hot water supply pipe 16 connected through branch pipes 18 with the washers 12. The washers 12 are provided with cold water from a main supply pipe 20 through a cold water supply pipe 22 connected by branches 24 with the washers 12. The main supply pipe 20 also supplies the water heater 14 with cold water through pipe 26.

Figure 2:
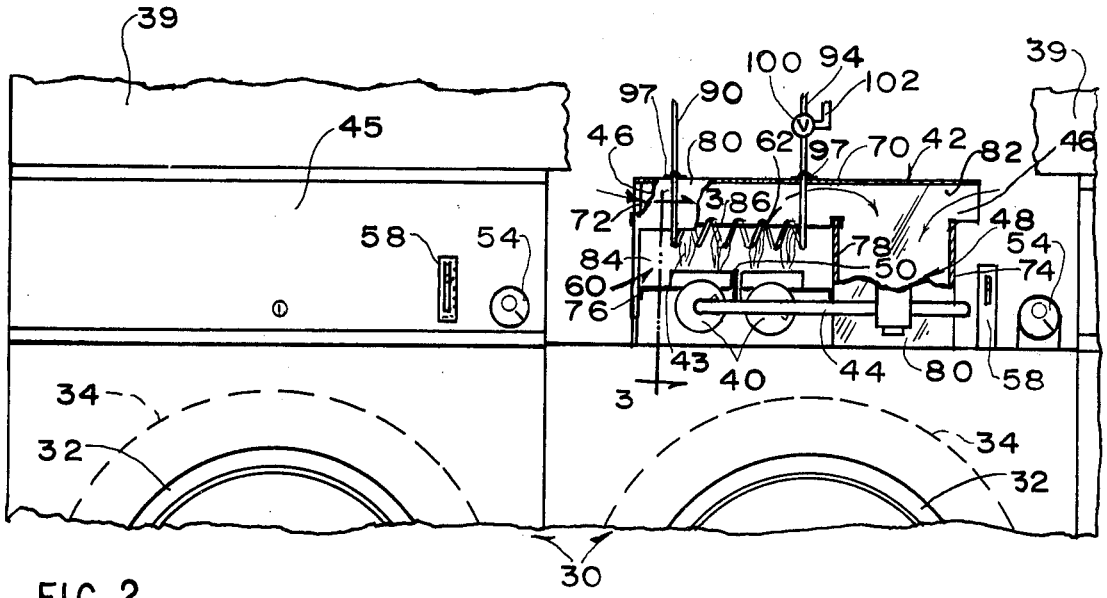
FIG. 2 is an enlarged, fragmentary, schematic elevational view of laundry dryers, as indicated generally by the line 2—2 in FIG. 1, with a top panel of one of the dryers removed to show the heating portion of the dryer, and with parts broken away and removed for clearer illustration.

With continuing reference to FIG. 1, a plurality of typical laundry dryers 30, such as a Huebsch dryer, Model 37A, each have the usual door 32 for insertion and removal of laundry from a perforated cylinder 34 or chamber (dashed lines, FIG. 2). During drying operation the cylinder 34 is rotated in typical manner by a suitable electric motor and drive assembly 36 on the rear of the dryer and this assembly also operates an exhaust blower (not shown) in the bottom portion of the dryer to exhaust the drying gas through a suitable vent or flue 38, the vents usually being connected with an exhaust duct (not shown).

With reference to FIGS. 2 and 3, a partition 39 is usually provided atop the front of the row of dryers 30 to conceal the piping, as 90–96. The upper portion of each dryer is provided with a drying system including a heater, usually of the combustion type, such as a gas burner unit 40 within a casing 42. Each burner unit 40 provides a combustion area 43, including a flame area, of relatively intense heat. Each burner unit 40 has the usual burner supply line and controls 44, and is concealed by a removable panel 45. The casing 42 provides opposed inlets 46 for air which mixes with the hot gases developed by the burner flames, the resultant warm gas passing downwardly through a duct 48 (FIG. 2) opening toward the laundry chamber 34.

With continuing reference to FIG. 2, a coin meter 54, upon insertion of a coin and turning of an actuator knob, initiates operation of a timer to provide a predetermined period of drying for each coin inserted and causes the motor drive assembly 36 to be turned on and gas to be provided through the supply line 44 to the burner unit 40 which is ignited by a pilot light 56 between the burners. The dryer 30 also has a temperature selection lever 58.

As illustrated in FIGS. 2 and 3, the hot water supply system comprises water heating apparatus 60 including the burner unit 40 and a water holder such as a coil 62 positioned immediately above the burner unit 40 in the flame area thereof and well upstream of the cylinder 34 relative to the flow of warm gas from the burner unit 40 through the duct 48.

The casing 42 includes a top wall 70 connected by suitable supports 72 with opposite side walls 74 and 76, with the air inlets 46 between each side wall and the top wall 70. The side wall 74, along with a center wall 78, define sides of the duct 48, and a front wall 80 and a rear wall 82 of the casing 42 provide front and rear closures of the duct 48.

Burner unit 40 is supported by cross members 84 secured to the side wall 76 and the center wall 78, and the coil 62 is supported by cross members 86 receiving upper tube runs of the coil and having inverted U-shaped ends seated on the top edge of the side wall 76 and the center wall 78. The bottom tube runs of the coil 62 are preferably about two inches above the burner gas orfices 83, and the front of the coil 62 is spaced rearwardly of the pilot 56 so that the water in the coil is not overheated by the pilot flame, thus avoiding the possibility of the water being appreciably heated when it is not circulating through the coils. If desired, the coil can be exposed to the pilot flame when water is being circulated 24 hours a day, to provide hot water during shutdown of the system as at night. With 10 dryers, the 10 pilot flames will heat the water in a 100 gallon storage tank from approximately 100° F. to 125° F. in approximately 10 hours. In a Huebsch Model 37A dryer, approximately eighteen feet of copper tubing of one-half or three-quarter inch inside diameter is formed into five convolutions with the coil being approximately sixteen inches long, nine inches wide, and approximately two and one-half inches high so that it may be installed through the burner access opening in the front wall 80 of the casing 42.

As may be noted best in FIGS. 2 and 3, a water circulating system is provided as follows: The front of each coil 62 has an inlet 89 and an outlet (not visable), the inlet connected with a cool water branch pipe 90 from a conduit defined by a cool water supply header or pipe 92 (FIG. 1) and the outlet connected with a heated water branch pipe 94 to a conduit defined by a heated water return header or pipe 96 (FIG. 1). Branch pipes 90 and 94 may be seated on the casing top 70 to receive heat from the top and may be secured to the top by pipe straps 97 (FIG. 2). The pipes 92 and 96 are preferably connected into the bottom portion of the storage tank of the automatic water heater 14, and a motor driven pump 98 is provided in the cool water supply pipe 92 to circulate the water and is operated by a suitable control system (not shown) when any of the dryers 30 are turned on by insertion of a coin and operation of the actuator knob of the coin-meter 54. Pressure relief valves 100 (FIG. 2) are preferably provided in each of the heated water branches 94 and preferably open into the drain lines 102.

With reference to the embodiment of FIG. 4, reference numerals primed, as 92', refer to the same or similar parts as those indicated by the same unprimed reference numerals in the embodiment of FIGS. 1–3, and will not necessarily be again described. In FIG. 4 a water circulating system comprises the cool water supply pipe 92' including a pipe 108 extending from the water heater 14' to a return portion 110 past the dryer farthest from the water heater 14', and then has a header 112 which returns along the series of dryers for connection with the cool water branch pipes 90' to each of the coils and terminates at the last branch pipe 90'. The heated water return header or pipe 96' is connected to the heated water branch pipes 94' from the coils as in the prior embodiment. In this water circulating system, the cool water in the cool water header 112 and the heated water in the heated water header 96' flows in the same direction in the areas to which the branch pipes 90' and 94' are connected so that the pressure differential between the inlets and outlets of each of the coils is substantially the same, assuring substantially the same rate of water flow through each of the coils and effectively eliminating a lack of water in any of the coils which might result in burning out of that coil.

A water circulating pump 98' is shown in FIG. 4 in the cool water supply pipe 92', as in the prior embodiment, and a second water circulating pump 114 is also provided in the heated water return header 96'. While two pumps, as 98' and 114, are preferred in order to provide a push-pull effect on the water being circulated and assure more positive circulation of the water and steam which might be present, a single pump may be provided in the system in only the heated water return header 96' as shown by the pump 114. A pump having a capacity of one gallon per minute per coil is adequate but under some circumstances it may be desirable to provide a pump with much greater capacity, for example, eight gallons per minute per coil in which event a far greater quantity of water is circulated per minute through the coils with the heated water returning to the water heater 14' at a lower temperature. These pump capacities, as well as the use of a single pump in either the supply pipe 92' or return header 96', or a separate pump in each, is equally applicable to the embodiment of FIGS. 1–3.

In FIG. 4 the pressure relief valves (100 not shown) are connected with the drain lines 102' in the cool water branch pipes 90' rather than in the heated water branch pipes 94' of each of the coils 62'. If the heated water temperature from the coils is desired at a higher temperature, it is preferable to provide the relief valves in the cool water branch pipes 90' in order to avoid possible overheating of these valves.

Increase in the delivered temperature of the heated water may be provided by a cross-over connection 116, as shown by phantom lines in FIG. 4, between the header 112 of the cool water supply pipe 92' and the heated water return header 96'. The cross-over connection 116 is intermediate the series of dryers 30' so that a portion of the heated water in the return header 96' may be by-passed into the header 112 of the cool water supply pipe 92', whereupon the dryer coils 62' downstream of the cross-over connection receive cool water at a substantially elevated temperature over that normally provided and the temperature of the water delivered to the heated water branch pipes 94' is therefore at a substantially higher temperature before passing into the heated water header 96'. The cross-over connection 116 is provided with a regulating valve 118, and a plurality of cross-over connections, as 116, may be spaced along the headers, as required.

In the previously mentioned commercial dryer, each gas burner unit 40 develops approximately 142,000 BTU per hour and will develop heated water to a temperature of at least 130° F. With cool water in the bottom of an 80 gallon tank of water heater 14 at 60° F. and with only one dryer 30 in the system, and the heater of the automatic water heater 14 off, in three minutes the water temperature in the heated water return pipe 96 rose to 68° F., after thirty minutes of operation to 138° F. and after forty minutes of operation to 142° F., with no hot water being withdrawn through the hot water supply pipe 16. Thus, by positioning the coil 62 closely proximate the burner units 40, water may be heated to adequate temperature for washing purposes. Any suitable flow rate of the pump 98 may be provided to keep the water circulating during dryer operation.

Since most coin operated laundries have two washers 12 for each dryer 30, during extended peak periods the hot water supply system of this invention assures a continual supply of hot water to the washers, and in the event of a sudden peak load, rather than the normal gradual peaking, the hot water heater 14 is usually able to supply adequate hot water until the laundry loads are transferred from the washers to the dryers, whereupon the dryers provide ample hot water for continued laundry operations.

While this invention has been described and illustrated with reference to particular embodiments in a particular environment, various changes may be apparent to one skilled in the art and the invention is therefore not to be limited to such embodiments or environment, except as set forth in the appended claims.

What is claimed is:

1. A laundry hot water supply system comprising, a plurality of dryers each having a chamber for receiving laundry to be dried and drying means operatively associated with said chamber for delivery of warm gas to the chamber to dry the laundry therein, each said drying means including heater means operable for heating the gas responsive to drying operation of the associated dryer, and water handling means including water holding means, one for each of said dryers, for holding water to be heated, each said holding means having an inlet for cool water and an outlet for heated water, each said holding means being intimately associated with the associated heater means upstream of said chamber relative to the flow of warm gas from said heater means to said chamber, for heating the water by means of the more intense heat generated proximate said heater means, and said water handling means further including circulating means for delivering cool water to said inlet and receiving the heated water from said outlet of each said holding means and for maintaining substantially the same pressure differential between the inlet and the outlet of each of said holding means.

2. A system as set forth in claim 1 in which said circulating means includes cool water conduit means for passage of the cool water to the inlets of said holding means and further includes heated water conduit means for passage of heated water from said outlets, the water in both said conduit means flowing in the same direction proximate connection with said inlets and said outlets.

3. A system as set forth in claim 1 in which said circulating means includes cool water conduit means for passage of the cool water to the inlets of said holding means and further includes heated water conduit means for passage of heated water from said outlets, said circulating means further includes a connection between said cool water conduit means and said heated water conduit means at an intermediate location along the plurality of holding means for increasing the temperature of the water delivered to said inlets downstream of said connection.

4. A system as set forth in claim 3 in which said connection includes valve means for regulating the quantity of water passing between said heated water conduit means and said cool water conduit means.

5. A system as set forth in claim 1 in which said circulating means includes pressure relief means, one associated with each of said holding means, and in circuit with the associated holding means adjacent the inlet thereof.

6. A system as set forth in claim 1 in which said heater means have sufficient heating capacity for heating the water at the associated holding means outlet to substantially a normal temperature for washing laundry and simultaneously heating a sufficient quantity of the warm gas for delivery to the associated chamber at a normal temperature for drying the laundry.

7. A system as set forth in claim 6 in which the circulating means includes water storage means for receiving the heated water, and laundry washer means for receiving the heated water from said storage means and washing the laundry, whereby as the quantity of laundry being washed and dried increases or decreases, the overall quantity of heated water delivered to said storage means increases or decreases, respectively.

8. A system as set forth in claim 7 in which each said heater means comprises burner means providing a combustion area during normal heating operation, and each said holding means comprises water carrying coil means in said combustion area of the associated burner means.

9. A system as set forth in claim 8 in which each said burner means comprises a fuel burner unit providing a flame area in said combustion area during normal heating operation thereof, and said coil means comprises water coil units, one for each of said dryers, each coil unit being in the flame area of the associated burner unit.

10. A system as set forth in claim 9 in a coin operated laundry in which said dryers are coin operated, said storage means is a water heater, said washer means comprises a plurality of coin operated laundry washers, and each said washer being connected with a heated water outlet of said storage means.

11. A system as set forth in claim 10 in which said circulating means includes a cool water header for passage of the cool water to the inlets of said holding means and further includes a heated water header for passage of heated water from said outlets, the water in both said headers flowing in the same direction proximate connection with said inlets and said outlets.

12. A system as set forth in claim 11 in which said circulating means includes pressure relief means, one associated with each of said holding means, and in circuit with the associated holding means adjacent the inlet thereof.

13. A system as set forth in claim 11 in which said circulating means further includes a cross-over connection between said cool water header and said heated water header at an intermediate location along the plurality of coil units for increasing the temperature of the water delivered to said inlets downstream of said connection, and said connection further includes valve means for regulating the quantity of water passing between said heated water header and said cool water header.

14. A system as set forth in claim 13 in which said circulating means includes pressure relief means, one associated with each of said holding means, and in circuit with the associated holding means adjacent the inlet thereof.

15. A system as set forth in claim 1 in which said circulating means includes cool water conduit means for passage of the cool water to the inlets of said holding means and further includes heated water conduit means for passage of heated water from said outlets, the water in both said conduit means flowing in the same direction proximate connection with said inlets and said outlets, and said circulating means further includes a connection between said cool water conduit means and said heated water conduit means at an intermediate location along the plurality of holding means for increasing the temperature of the water delivered to said inlets downstream of said connection.

16. A system as set forth in claim 15 in which said connection includes valve means for regulating the quantity of water passing between said heated water conduit means and said cool water conduit means.

17. A laundry hot water supply system comprising, a plurality of dryers each having a chamber for receiving laundry to be dried and drying means operatively associated with said chamber for delivery of warm gas to the chamber to dry the laundry therein, each said drying means including heater means operable for heating the gas responsive to drying operation of the associated dryer, and water handling means including water holding means, one for each of said dryers, for holding water to be heated, each said holding means having an inlet for cool water and an outlet for heated water, each said holding means being associated with the associated heater means for heating the water therein, said water handling means further including circulating means for delivering cool water to said inlet and receiving the heated water from said outlet of each said holding means, said circulating means including cool water conduit means for passage of cool water to the inlets of said holding means and heated water conduit means for passage of heated water from the outlets of said holding means, said circulating means further including a cross-over connection between said cool water conduit means and said heated conduit means at an intermediate location along the plurality of said water holding means.

18. The system defined in claim 17 wherein said crossover connection includes a valve means for controlling the quantity of water passing between the cool water conduit means and the heated water conduit means.

19. The system defined in claim 17 wherein said circulating means further includes a pump located in one of said cool water conduit means and said heated water conduit means for circulating water through said system, and wherein said circulating means further includes pressure relief means associated with each one of said holding means for controlling the pressure therein.

* * * * *